US008820293B1

(12) United States Patent
McAlister

(10) Patent No.: US 8,820,293 B1
(45) **Date of Patent: *Sep. 2, 2014**

(54) INJECTOR-IGNITER WITH THERMOCHEMICAL REGENERATION

(71) Applicant: McAlister Technologies, LLC, Phoenix, AZ (US)

(72) Inventor: Roy Edward McAlister, Phoenix, AZ (US)

(73) Assignee: McAlister Technologies, LLC, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/841,548

(22) Filed: Mar. 15, 2013

(51) Int. Cl.
*F02M 57/06* (2006.01)

(52) U.S. Cl.
CPC ..... *F02M 57/06* (2013.01)
USPC ..... 123/297; 123/490

(58) Field of Classification Search
USPC ..... 123/297, 298, 467–470, 490, 499
See application file for complete search history.

(56) References Cited

U.S. PATENT DOCUMENTS

| | | | |
|---|---|---|---|
| 1,307,088 | A | 6/1919 | Drummond |
| 1,451,384 | A | 4/1923 | Whyte |
| 1,765,237 | A | 6/1930 | King |
| 2,255,203 | A | 9/1941 | Wiegand |
| 2,681,212 | A | 6/1954 | Thomas |
| 2,744,507 | A | 5/1956 | Huber |
| 2,864,974 | A | 12/1958 | Beye |
| 3,058,453 | A | 10/1962 | May |
| 3,060,912 | A | 10/1962 | May |
| 3,081,758 | A | 3/1963 | May |
| 3,243,335 | A | 3/1966 | Faile |
| 3,373,724 | A | 3/1968 | Papst |
| 3,520,961 | A | 7/1970 | Suda et al. |
| 3,551,738 | A | 12/1970 | Young |
| 3,594,877 | A | 7/1971 | Suda et al. |
| 3,608,050 | A | 9/1971 | Carman et al. |

(Continued)

FOREIGN PATENT DOCUMENTS

| | | | |
|---|---|---|---|
| DE | 3443022 | A1 | 5/1986 |
| EP | 392594 | A2 | 10/1990 |

(Continued)

OTHER PUBLICATIONS

"Ford DIS/EDIS "Waste Spark" Ignition System." Accessed: Jul. 15, 2010. Printed: Jun. 8, 2011. <http://rockledge.home.comcast.net/~rockledge/RangerPictureGallery/DIS_EDIS.htm>. pp. 1-6.

(Continued)

*Primary Examiner* — John Kwon
(74) *Attorney, Agent, or Firm* — Perkins Coie LLP

(57) ABSTRACT

A fuel injection system comprising an injector-igniter and a fuel tank in fluid communication with the injector-igniter. The injector igniter includes an injector housing and a valve assembly. The valve assembly includes a valve and a valve seat electrode located within the injector housing. The valve seat electrode forms an annular spark gap between the electrode and an electrode portion of the injector housing. An actuator, such as a piezoelectric actuator, is disposed in the housing and connected to the valve. In some embodiments, the system further comprises a thermochemical reactor operatively coupled to the injector-igniter to provide a supplemental supply of hydrogen for combustion enhancement. In other embodiments, a hydraulic stroke amplifier is disposed between the actuator and valve.

20 Claims, 10 Drawing Sheets

(56) References Cited

U.S. PATENT DOCUMENTS 3,689,293 A 9/1972 Beall
3,866,074 A 2/1975 Smith
3,926,169 A 12/1975 Leshner et al.
3,931,438 A 1/1976 Beall et al.
3,960,995 A 6/1976 Kourkene
3,976,039 A 8/1976 Henault
3,997,352 A 12/1976 Beall
4,066,046 A 1/1978 McAlister
4,087,719 A 5/1978 Pratt, Jr.
4,095,580 A 6/1978 Murray et al.
4,122,816 A 10/1978 Fitzgerald et al.
4,135,481 A 1/1979 Resler, Jr.
RE29,978 E * 5/1979 Leshner et al. ..... 123/297
4,203,393 A 5/1980 Giardini
4,330,732 A 5/1982 Lowther
4,332,223 A 6/1982 Dalton
4,364,342 A 12/1982 Asik
4,377,455 A 3/1983 Kadija et al.
4,381,740 A 5/1983 Crocker
4,382,189 A 5/1983 Wilson
4,448,160 A 5/1984 Vosper
4,469,160 A 9/1984 Giamei
4,483,485 A 11/1984 Kamiya et al.
4,511,612 A 4/1985 Huther et al.
4,528,270 A 7/1985 Matsunaga
4,536,452 A 8/1985 Stempin et al.
4,567,857 A 2/1986 Houseman et al.
4,574,037 A 3/1986 Samejima et al.
4,677,960 A 7/1987 Ward
4,688,538 A 8/1987 Ward et al.
4,733,646 A 3/1988 Iwasaki
4,736,718 A 4/1988 Linder
4,742,265 A 5/1988 Giachino et al.
4,760,818 A 8/1988 Brooks et al.
4,760,820 A 8/1988 Tozzi
4,774,914 A 10/1988 Ward
4,774,919 A 10/1988 Matsuo et al.
4,834,033 A 5/1989 Larsen
4,841,925 A 6/1989 Ward
4,922,883 A 5/1990 Iwasaki
4,932,263 A 6/1990 Wlodarczyk
4,967,708 A 11/1990 Linder et al.
4,977,873 A 12/1990 Cherry et al.
4,982,708 A 1/1991 Stutzenberger
5,034,852 A 7/1991 Rosenberg
5,055,435 A 10/1991 Hamanaka et al.
5,056,496 A 10/1991 Morino et al.
5,072,617 A 12/1991 Weiss
5,076,223 A 12/1991 Harden et al.
5,095,742 A 3/1992 James et al.
5,109,817 A 5/1992 Cherry
5,131,376 A 7/1992 Ward et al.
5,193,515 A 3/1993 Oota et al.
5,207,208 A 5/1993 Ward
5,211,142 A 5/1993 Matthews et al.
5,220,901 A 6/1993 Morita et al.
5,267,601 A 12/1993 Dwivedi
5,297,518 A 3/1994 Cherry
5,305,360 A 4/1994 Remark et al.
5,328,094 A 7/1994 Goetzke et al.
5,377,633 A 1/1995 Wakeman
5,390,546 A 2/1995 Wlodarczyk
5,392,745 A 2/1995 Beck
5,394,838 A 3/1995 Chandler
5,421,195 A 6/1995 Wlodarczyk
5,421,299 A 6/1995 Cherry
5,435,286 A 7/1995 Carroll, III et al.
5,439,532 A 8/1995 Fraas
5,456,241 A 10/1995 Ward
5,475,772 A 12/1995 Hung et al.
5,497,744 A 3/1996 Nagaosa et al.
5,517,961 A 5/1996 Ward
5,531,199 A * 7/1996 Bryant et al. ..... 123/297
5,549,746 A 8/1996 Scott et al.
5,584,490 A 12/1996 Inoue et al.
5,588,299 A 12/1996 DeFreitas
5,605,125 A 2/1997 Yaoita
5,607,106 A 3/1997 Bentz et al.
5,662,389 A 9/1997 Truglio et al.
5,676,026 A 10/1997 Tsuboi et al.
5,694,761 A 12/1997 Griffin, Jr.
5,699,253 A 12/1997 Puskorius et al.
5,702,761 A 12/1997 DiChiara, Jr. et al.
5,704,321 A 1/1998 Suckewer et al.
5,715,788 A 2/1998 Tarr et al.
5,738,818 A 4/1998 Atmur et al.
5,746,171 A 5/1998 Yaoita
5,767,026 A 6/1998 Kondoh et al.
5,797,427 A 8/1998 Buescher
5,806,581 A 9/1998 Haasch et al.
5,853,175 A 12/1998 Udagawa
5,863,326 A 1/1999 Nause et al.
5,876,659 A 3/1999 Yasutomi et al.
5,915,272 A 6/1999 Foley et al.
5,941,207 A 8/1999 Anderson et al.
5,975,032 A 11/1999 Iwata
5,975,433 A 11/1999 Hasegawa et al.
5,983,855 A 11/1999 Benedikt et al.
6,017,390 A 1/2000 Charych et al.
6,026,568 A 2/2000 Atmur et al.
6,062,498 A 5/2000 Klopfer
6,065,692 A 5/2000 Brinn, Jr.
6,081,183 A 6/2000 Mading et al.
6,085,990 A 7/2000 Augustin
6,092,501 A 7/2000 Matayoshi et al.
6,092,507 A 7/2000 Bauer et al.
6,093,338 A 7/2000 Tani et al.
6,102,303 A 8/2000 Bright et al.
6,131,607 A 10/2000 Cooke
6,138,639 A 10/2000 Hiraya et al.
6,173,913 B1 1/2001 Shafer et al.
6,185,355 B1 2/2001 Hung
6,186,419 B1 2/2001 Kampmann et al.
6,189,522 B1 2/2001 Moriya
6,253,728 B1 7/2001 Matayoshi et al.
6,267,307 B1 7/2001 Pontoppidan
6,335,065 B1 1/2002 Steinlage et al.
6,338,445 B1 1/2002 Lambert et al.
6,360,721 B1 3/2002 Schuricht et al.
6,378,485 B2 4/2002 Elliott
6,386,178 B1 5/2002 Rauch
6,453,660 B1 9/2002 Johnson et al.
6,455,173 B1 9/2002 Marijnissen et al.
6,478,007 B2 11/2002 Miyashita et al.
6,506,336 B1 1/2003 Beall et al.
6,517,011 B1 2/2003 Ayanji et al.
6,532,315 B1 3/2003 Hung et al.
6,536,405 B1 3/2003 Rieger et al.
6,567,599 B2 5/2003 Hung
6,568,362 B2 5/2003 Whealton et al.
6,578,775 B2 6/2003 Hokao
6,583,901 B1 6/2003 Hung
6,584,244 B2 6/2003 Hung
6,587,239 B1 7/2003 Hung
6,615,899 B1 9/2003 Woodward et al.
6,647,948 B2 11/2003 Kyuuma et al.
6,663,027 B2 12/2003 Jameson et al.
6,672,277 B2 1/2004 Yasuoka et al.
6,687,597 B2 2/2004 Sulatisky et al.
6,700,306 B2 3/2004 Nakamura et al.
6,705,274 B2 3/2004 Kubo
6,712,035 B2 3/2004 Gottemoller et al.
6,722,340 B1 4/2004 Sukegawa et al.
6,725,826 B2 4/2004 Esteghlal
6,745,744 B2 6/2004 Suckewer et al.
6,748,918 B2 6/2004 Rieger et al.
6,749,043 B2 6/2004 Brown et al.
6,763,811 B1 7/2004 Tamol, Sr.
6,776,358 B2 8/2004 Arimoto
6,796,516 B2 9/2004 Maier et al.
6,832,588 B2 12/2004 Herden et al.
6,845,608 B2 1/2005 Klenk et al.
6,845,920 B2 1/2005 Sato et al.
6,850,069 B2 2/2005 McQueeney et al.

(56) References Cited

U.S. PATENT DOCUMENTS

| | | | | |
|---|---|---|---|---|
| 6,851,413 | B1 | 2/2005 | Tamol, Sr. | |
| 6,871,630 | B2 | 3/2005 | Herden et al. | |
| 6,881,386 | B2 | 4/2005 | Rabinovich et al. | |
| 6,883,490 | B2 | 4/2005 | Jayne | |
| 6,899,076 | B2 | 5/2005 | Funaki et al. | |
| 6,904,893 | B2 | 6/2005 | Hotta et al. | |
| 6,912,998 | B1 | 7/2005 | Rauznitz et al. | |
| 6,925,983 | B2 | 8/2005 | Herden et al. | |
| 6,940,213 | B1 | 9/2005 | Heinz et al. | |
| 6,959,693 | B2 | 11/2005 | Oda | |
| 6,976,683 | B2 | 12/2005 | Eckert et al. | |
| 6,994,073 | B2 | 2/2006 | Tozzi et al. | |
| 7,007,658 | B1 | 3/2006 | Cherry et al. | |
| 7,013,863 | B2 | 3/2006 | Shiraishi et al. | |
| 7,025,358 | B2 | 4/2006 | Ueta et al. | |
| 7,032,845 | B2 | 4/2006 | Dantes et al. | |
| 7,070,126 | B2 | 7/2006 | Shinogle | |
| 7,073,480 | B2 | 7/2006 | Shiraishi et al. | |
| 7,086,376 | B2 | 8/2006 | McKay | |
| 7,104,246 | B1 | 9/2006 | Gagliano et al. | |
| 7,104,250 | B1 | 9/2006 | Yi et al. | |
| 7,121,253 | B2 | 10/2006 | Shiraishi et al. | |
| 7,131,426 | B2 | 11/2006 | Ichinose et al. | |
| 7,140,347 | B2 | 11/2006 | Suzuki et al. | |
| 7,249,578 | B2 | 7/2007 | Fricke et al. | |
| 7,255,290 | B2 | 8/2007 | Bright et al. | |
| 7,275,374 | B2 | 10/2007 | Stewart et al. | |
| 7,278,392 | B2 | 10/2007 | Zillmer et al. | |
| 7,278,396 | B2 | 10/2007 | Leone et al. | |
| 7,287,492 | B2 | 10/2007 | Leone et al. | |
| 7,293,552 | B2 | 11/2007 | Leone et al. | |
| 7,302,933 | B2 | 12/2007 | Kerns | |
| 7,309,029 | B2 | 12/2007 | Boecking | |
| 7,357,101 | B2 | 4/2008 | Boyarski | |
| 7,406,947 | B2 | 8/2008 | Lewis et al. | |
| 7,409,929 | B2 | 8/2008 | Miyahara et al. | |
| 7,412,966 | B2 | 8/2008 | Lewis et al. | |
| 7,418,940 | B1 | 9/2008 | Yi et al. | |
| 7,449,034 | B1 | 11/2008 | Mikkelsen et al. | |
| 7,481,043 | B2 | 1/2009 | Hirata et al. | |
| 7,513,222 | B2 | 4/2009 | Orlosky | |
| 7,554,250 | B2 | 6/2009 | Kadotani et al. | |
| 7,625,531 | B1 | 12/2009 | Coates et al. | |
| 7,626,315 | B2 | 12/2009 | Nagase | |
| 7,650,873 | B2 | 1/2010 | Hofbauer et al. | |
| 7,703,435 | B2 | 4/2010 | Surnilla et al. | |
| 7,703,775 | B2 | 4/2010 | Matsushita et al. | |
| 7,707,832 | B2 | 5/2010 | Commaret et al. | |
| 7,714,483 | B2 | 5/2010 | Hess et al. | |
| 7,728,489 | B2 | 6/2010 | Heinz et al. | |
| 7,775,188 | B2 | 8/2010 | Ehrlich | |
| 7,849,833 | B2 | 12/2010 | Toyoda | |
| 7,861,696 | B2 | 1/2011 | Lund | |
| 7,918,212 | B2 | 4/2011 | Verdejo et al. | |
| 8,069,836 | B2 | 12/2011 | Ehresman | |
| 8,147,599 | B2 | 4/2012 | McAlister | |
| 8,312,759 | B2 | 11/2012 | McAlister | |
| 8,318,131 | B2 | 11/2012 | McAlister | |
| 8,322,325 | B2 | 12/2012 | Rogak et al. | |
| 8,387,599 | B2 * | 3/2013 | McAlister | 123/675 |
| 8,441,361 | B2 | 5/2013 | McAlister | |
| 8,601,819 | B2 | 12/2013 | Hammer et al. | |
| 8,646,432 | B1 * | 2/2014 | McAlister et al. | 123/297 |
| 2002/0017573 | A1 | 2/2002 | Sturman | |
| 2002/0084793 | A1 | 7/2002 | Hung et al. | |
| 2002/0131171 | A1 | 9/2002 | Hung | |
| 2002/0131666 | A1 | 9/2002 | Hung et al. | |
| 2002/0131673 | A1 | 9/2002 | Hung | |
| 2002/0131674 | A1 | 9/2002 | Hung | |
| 2002/0131706 | A1 | 9/2002 | Hung | |
| 2002/0131756 | A1 | 9/2002 | Hung | |
| 2002/0141692 | A1 | 10/2002 | Hung | |
| 2002/0150375 | A1 | 10/2002 | Hung et al. | |
| 2002/0151113 | A1 | 10/2002 | Hung et al. | |
| 2004/0008989 | A1 | 1/2004 | Hung | |
| 2005/0255011 | A1 | 11/2005 | Greathouse et al. | |
| 2006/0005738 | A1 | 1/2006 | Kumar | |
| 2006/0005739 | A1 | 1/2006 | Kumar | |
| 2006/0037563 | A1 | 2/2006 | Raab et al. | |
| 2007/0189114 | A1 | 8/2007 | Reiner et al. | |
| 2009/0093951 | A1 | 4/2009 | McKay et al. | |
| 2010/0077986 | A1 | 4/2010 | Chen | |
| 2010/0183993 | A1 * | 7/2010 | McAlister | 431/254 |
| 2011/0036309 | A1 * | 2/2011 | McAlister | 123/3 |
| 2011/0042476 | A1 * | 2/2011 | McAlister | 239/5 |
| 2011/0253104 | A1 * | 10/2011 | McAlister | 123/445 |
| 2011/0297753 | A1 | 12/2011 | McAlister et al. | |
| 2013/0043323 | A1 * | 2/2013 | McAlister | 239/5 |
| 2013/0074333 | A1 * | 3/2013 | McAlister | 29/887 |
| 2013/0149621 | A1 | 6/2013 | McAlister | |
| 2014/0041631 | A1 * | 2/2014 | McAlister | 123/445 |

FOREIGN PATENT DOCUMENTS

| | | | |
|---|---|---|---|
| GB | 1038490 | A | 8/1966 |
| JP | 61-023862 | A | 2/1986 |
| JP | 2009-287549 | A | 12/2009 |

OTHER PUBLICATIONS

"P dV's Custom Data Acquisition Systems Capabilities." PdV Consulting. Accessed: Jun. 28, 2010. Printed: May 16, 2011. <http://www.pdvconsult.com/capabilities%20-%20daqsys.html>. pp. 1-10.

"Piston motion equations." Wikipedia, the Free Encyclopedia. Published: Jul. 4, 2010. Accessed: Aug. 7, 2010. Printed: Aug. 7, 2010. <http://en.wikipedia.org/wiki/Dopant>. pp. 1-9.

"Piston Velocity and Acceleration." EPI, Inc. Accessed: Jun. 28, 2010. Printed: May 16, 2011. <http://www.epi-eng.com/piston_engine_technology/piston_velocity_and_acceleration.htm>. pp. 1-3.

"SmartPlugs—Aviation." SmartPlugs.com. Published: Sep. 2000. Accessed: May 31, 2011. <http://www.smartplugs.com/news/aeronews0900.htm>. pp. 1-3.

Birchenough, Arthur G. "A Sustained-arc Ignition System for Internal Combustion Engines." Nasa Technical Memorandum (NASA TM-73833). Lewis Research Center. Nov. 1977. pp. 1-15.

Doggett, William. "Measuring Internal Combustion Engine In-Cylinder Pressure with LabVIEW." National Instruments. Accessed: Jun. 28, 2010. Printed: May 16, 2011. <http://sine.ni.com/cs/app/doc/p/id/cs-217>. pp. 1-2.

Erjavec, Jack. "Automotive Technology: a Systems Approach, vol. 2." Thomson Delmar Learning. Clifton Park, NY. 2005. p. 845.

Hollembeak, Barry. "Automotive Fuels & Emissions." Thomson Delmar Learning. Clifton Park, NY. 2005. p. 298.

InfraTec GmbH. "Evaluation Kit for FPI Detectors | Datasheet—Detector Accessory." 2009. pp. 1-2.

Lewis Research Center. "Fabry-Perot Fiber-Optic Temperature Sensor." NASA Tech Briefs. Published: Jan. 1, 2009. Accessed: May 16, 2011. <http://www.techbriefs.com/content/view/2114/32/>.

Riza et al. "All-Silicon Carbide Hybrid Wireless-Wired Optics Temperature Sensor Network Basic Design Engineering for Power Plant Gas Turbines." International Journal of Optomechatronics, vol. 4, Issue 1. Jan. 2010. pp. 1-9.

Riza et al. "Hybrid Wireless-Wired Optical Sensor for Extreme Temperature Measurement in Next Generation Energy Efficient Gas Turbines." Journal of Engineering for Gas Turbines and Power, vol. 132, Issue 5. May 2010. pp. 051601-1-51601-11.

* cited by examiner

INJECTOR-IGNITER WITH THERMOCHEMICAL REGENERATION

BACKGROUND

In instances in which alternative fuels with low cetane ratings, such as hydrogen, methane, producer gas, and fuel alcohols, are substituted for diesel fuel in engines designed for compression ignition, it is necessary to provide positive ignition to enable suitable combustion and application of such alternative fuels. Optimized application of each alternative fuel selection requires adjustment of variables such as the timing of fuel injection and ignition events along with the amount of energy that is applied to pressurize and ignite the delivered fuel. Accordingly, there is a need for fuel system hardware and methods to facilitate the optimization of variables associated with injection and ignition of various alternative fuels.

BRIEF DESCRIPTION OF THE DRAWINGS

Non-limiting and non-exhaustive embodiments of the devices, systems, and methods, including the preferred embodiment, are described with reference to the following figures, wherein like reference numerals refer to like parts throughout the various views unless otherwise specified.

DETAILED DESCRIPTION

Figure 1:
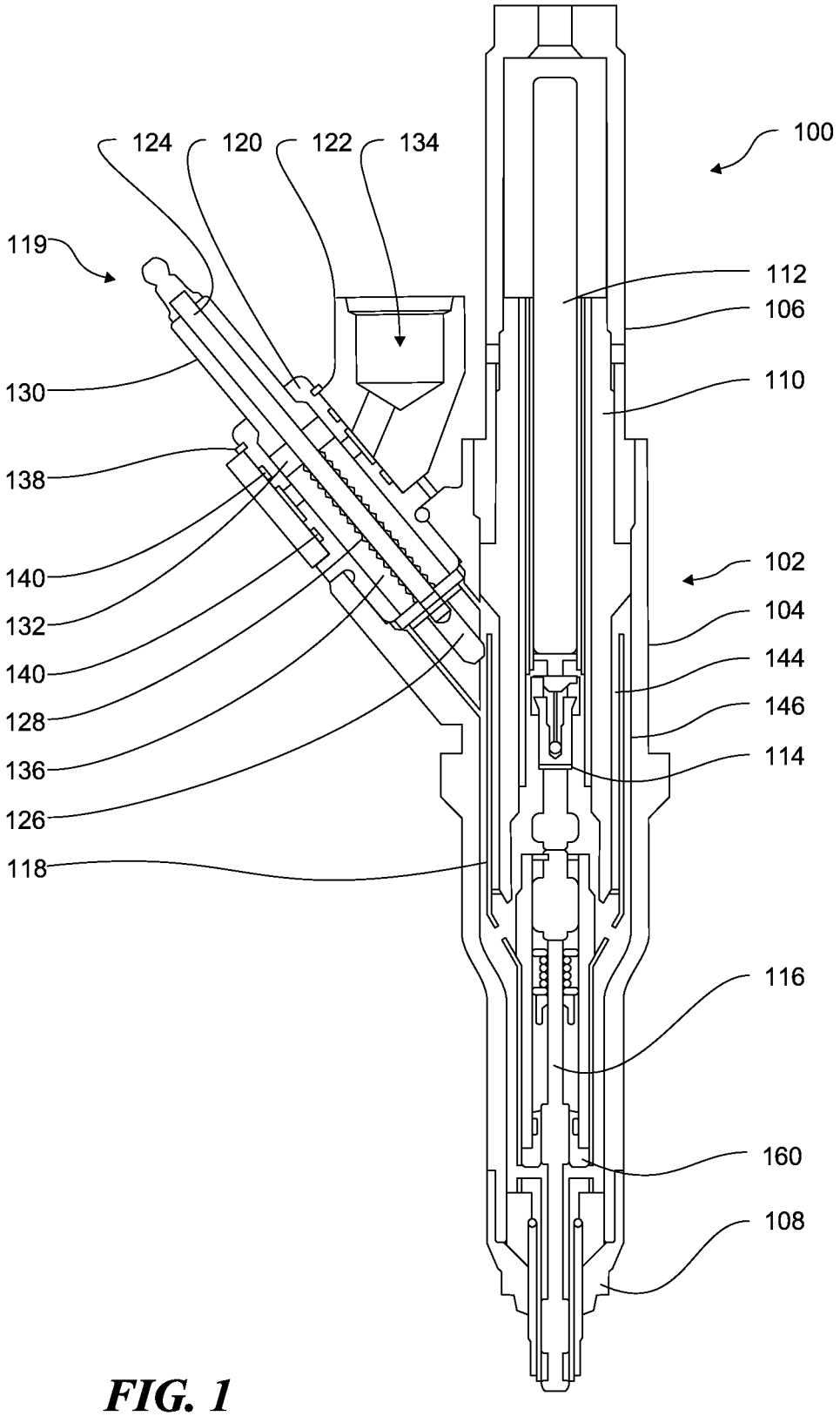
FIG. 1 is a cross-sectional side view of an injector-igniter according to a representative embodiment.

Disclosed herein are fuel injection systems including fuel delivery and ignition capability as well as hydrogen generation for combustion enhancement. In an embodiment, a fuel injection system comprises an injector-igniter and a fuel tank in fluid communication with the injector-igniter. The injector-igniter includes an injector housing and a valve assembly. The valve assembly includes a valve and a valve seat electrode located within the injector housing. The valve seat electrode forms an annular spark gap between the electrode and an electrode portion of the injector housing. A ceramic insulator tube may be positioned between the injector housing and valve seat electrode. An actuator, such as a piezoelectric actuator, is disposed in the housing and connected to the valve. In some embodiments, the system further comprises a thermo-chemical reactor operatively coupled to the injector-igniter to provide a supplemental supply of hydrogen for combustion enhancement. In other embodiments, a hydraulic stroke amplifier is disposed between the actuator and valve. In some embodiments, a mechanical stroke amplifier may be disposed between the actuator and valve. In some embodiments a conductor sleeve may be supported between the actuator and injector housing with a first annular gap between the injector housing and the conductor sleeve and a second annular gap between the actuator body and conductor sleeve. The first and second annular gaps may be in fluid communication with a fuel inlet, whereby fuel provides a dielectric between the conductor sleeve and the injector housing. In some embodiments fluid communication is provided at an injector housing location that is thermally and/or chemically isolated or sufficiently separated to reduce or eliminate the heat exchange and/or chemical contact between the actuator assembly and the valve to accommodate very cold, or corrosive, or very hot fluid and/or fuel substances.

Specific details of several embodiments of the technology are described below with reference to FIGS. 1-8B. Other details describing well-known fuel system and ignition components, such as fuel pumps, regulators, and the like, have not been set forth in the following disclosure to avoid unnecessarily obscuring the description of the various embodiments of the technology. Many of the details, dimensions, angles, and other features shown in the figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1-8B.

Some aspects of the technology described below may take the form of or make use of computer-executable instructions, including routines executed by a programmable computer. Those skilled in the relevant art will appreciate that the technology can be practiced on computer systems other than those shown and described below. The technology can be embodied in a special-purpose computer or data processor, such as an engine control unit (ECU), engine control module (ECM), fuel system controller, or the like, that is specifically programmed, configured or constructed to perform one or more computer-executable instructions consistent with the technology described below. Accordingly, the term "computer," "processor," or "controller" as generally used herein refers to any data processor and can include ECUs, ECMs, and modules, as well as Internet appliances and hand-held devices (including palm-top computers, wearable computers, cellular or mobile phones, multi-processor systems, processor-based or programmable consumer electronics, network computers, mini computers and the like). Information handled by these computers can be presented at any suitable display medium, including a CRT display, LCD, or dedicated display device or mechanism (e.g., a gauge).

The technology can also be practiced in distributed environments, where tasks or modules are performed by remote processing devices that are linked through a communications network. In a distributed computing environment, program modules or subroutines may be located in local and remote memory storage devices. Aspects of the technology described below may be stored or distributed on computer-readable media, including magnetic or optically readable or removable computer disks, as well as distributed electronically over networks. Such networks may include, for example and without limitation, Controller Area Networks (CAN), Local Interconnect Networks (LIN), and the like. In particular embodiments, data structures and transmissions of data particular to aspects of the technology are also encompassed within the scope of the technology.

FIG. 1 illustrates an injector-igniter 100 according to a representative embodiment that includes an injector housing 102, an actuator 112, a valve assembly 116, and a stroke amplifier 114 disposed between the actuator and valve. Injector housing 102 includes a main body 104 with a nozzle cap 108 and an end cap 106 threadably attached thereto. End cap 106 encloses an actuator body 110, which together contain actuator 112.

An electrode connector 119 extends laterally from the main body 104 of injector housing 102. The electrode connector 119 includes an inlet/electrode fitting 120 that engages the main body 104 by a suitable assembly technology such as threads and/or an interference fit sealing and clamping region. An elongate electrode 124 is supported within inlet/electrode fitting 120 by an electrode insulator 130 and a glass seal 132. Glass seal 132 is operative to provide a hermetic seal between electrode 124 and inlet/electrode fitting 120. Electrode connector 119 further includes an electrode tip 126 that is spring loaded by electrode spring 128 to maintain electrical contact with conductor sleeve 118. In some embodiments, electrode tip 126 may be welded or brazed to spring 128. Conductor sleeve 118 is supported between the actuator body 110 and the injector housing main body 104. Conductor sleeve 118 defines an inner annular gap 144 between actuator body 110 and conductor sleeve 118. Conductor sleeve 118 also defines an outer annular gap 146 between the main body 104 and conductor sleeve 118.

An inlet sleeve 122 is rotatably disposed on inlet/electrode fitting 120. Inlet sleeve 122 includes an inlet port 134 that is in fluid communication with an annular inlet region 136. Inlet port 134 is adapted to receive a suitable fuel supply connection, thereby providing fuel to the injector-igniter 100. Inlet sleeve 122 is retained on inlet/electrode fitting 120 by a retaining ring 138, and one or more insulator seals, such as a pair of O-rings 140 are operative to seal inlet sleeve 122 against the inlet/electrode fitting 120. Inlet region 136 is in fluid communication with both the inner and outer annular gaps 144, 146 as well as valve assembly 116, as explained more fully below. Accordingly, fuel fills the inlet region 136, inner annular gap 144, and outer annular gap 146. In some embodiments, the fuel (e.g., compressed natural gas, propane, ethane, or butane) acts as a dielectric fluid to insulate the various components of the ignition circuit of injector-igniter 100. In some embodiments, fuel selections are occasionally modified with crack healing agents that penetrate incipient cracks in polymer, glass or ceramic insulators to provide a smoothed resurfacing and/or restoration of insulative performance and endurance. Such embodiments facilitate tighter packaging of the injector and reduce the amount of ceramic materials necessary in the design. In other embodiments, the ignition components are insulated with solid insulators such as glass or ceramic. As mentioned above, electrode 124 is in electrical communication with conductor sleeve 118 via electrode tip 126. Conductor sleeve 118 is also in electrical communication with the valve seat electrode 160, which is part of valve assembly 116.

Figure 2:
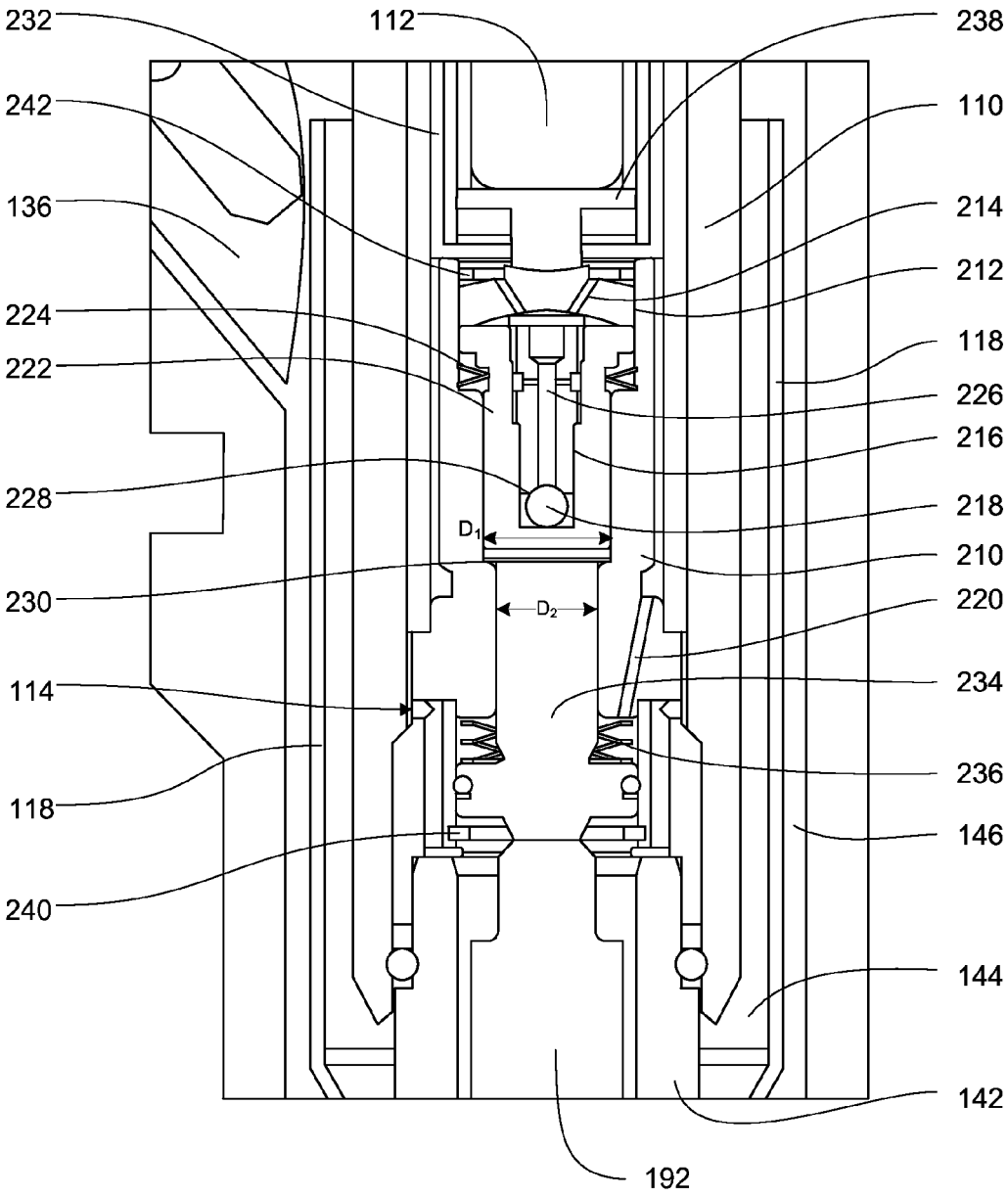
FIG. 2 is an enlarged partial cross-section of the injector-igniter shown in FIG. 1 illustrating the construction of a hydraulic stroke amplifier.

In this embodiment, actuator 112 is a stacked piezoelectric actuator which may provide the desired actuation force and motion magnitude or may operate through stroke amplifier 114 to actuate valve assembly 116. Although actuator 112 is described in this embodiment as a piezoelectric device, other suitable actuators may be used. In other embodiments, actuator 112 may be a solenoid, magnetostrictive, piezoelectric, pneumatic, or hydraulic actuator, for example. With further reference to FIG. 2, it can be appreciated that actuator 112 acts against an actuator seat 238 which in turn actuates stroke amplifier 114. While piezoelectric actuators provide high actuation force (e.g., approx. 600N), they have limited linear displacement capabilities (e.g., 130 to 230 microns). Thus, in some applications it is necessary to amplify the stroke of the actuator to provide sufficient stroke to open the valve assembly 116 (as shown in FIG. 1). Stroke amplifier 114 includes an amplifier housing 210 which contains an anvil 212 that interfaces with actuator seat 238. As can be appreciated from the figure, actuator seat 238 and anvil 212 include spherical surfaces to facilitate self-alignment of the actuator 112 and the stroke amplifier 114. Anvil 212 in turn acts against amplifier piston 222.

Amplifier piston 222 has a diameter $D_1$ which acts against hydraulic fluid in working volume 230. Working volume 230 contains a hydraulic fluid which is displaced by amplifier piston 222 upon actuation by actuator 112. The displaced working fluid under amplifier piston 222 is displaced into a smaller diameter $D_2$ corresponding to drive piston 234. Accordingly, a small displacement of amplifier piston 222 is amplified by a ratio of the effective areas of amplifier piston 222 and drive piston 234. For example, in an embodiment, $D_1$ is 7 mm and $D_2$ is 5.2 mm providing an amplification ratio of 1.8:1 (ideal for some applications and may be adjusted to larger or smaller rations for other applications). It is expected that some stroke amplification may be lost or gained due to thermal expansion, compressibility of the hydraulic fluid and/or leakage.

Amplifier piston 222 is biased away from working volume 230 by amplifier spring 224. Similarly drive piston 234 is biased away from working volume 230 by drive piston spring 236. In other embodiments, magnets and/or springs may be used. In an embodiment, both the amplifier spring 224 and drive piston spring 236 comprise Belleville washers stacked together to provide the desired spring rate. Biasing both the amplifier piston 222 and drive piston 234 away from working volume 230 insures that full stroke amplification is available for multiple injection cycles. Furthermore, spring biasing the pistons in this manner helps to reduce backlash in the amplifier system. Stroke amplifier 114 also absorbs effects due to thermal growth, thermal shrinkage, part geometry changes due to loads, gravitational effects, etc. that would otherwise limit the working limits or actuator functionality of the device.

Anvil 212 includes anvil passages 214 that allow hydraulic fluid to flow from reservoir volume 232 into a check valve insert 216 included in amplifier piston 222. Hydraulic fluid flows into check valve passage 226 and through check seat 228 to fill the working volume 230. The check ball 218 is positioned adjacent to check valve seat 228 and is operative to close check passage 226 upon actuation of amplifier piston 222. Reservoir volume 232 extends around actuator 112 and around a portion of amplifier housing 210. Any hydraulic fluid that escapes past diameter $D_2$ of drive piston 234 is returned to reservoir volume 232 via return passage 220. In this embodiment, stroke amplifier 114 is a self-contained assembly, the components of which are housed in amplifier housing 210 and retained therein by retainer rings 240 and 242. The stroke amplifier 114 is inserted into actuator body 110. Drive piston 234 pushes against plunger 192 to actuate valve assembly 116 (as shown in FIG. 1).

Figure 3:
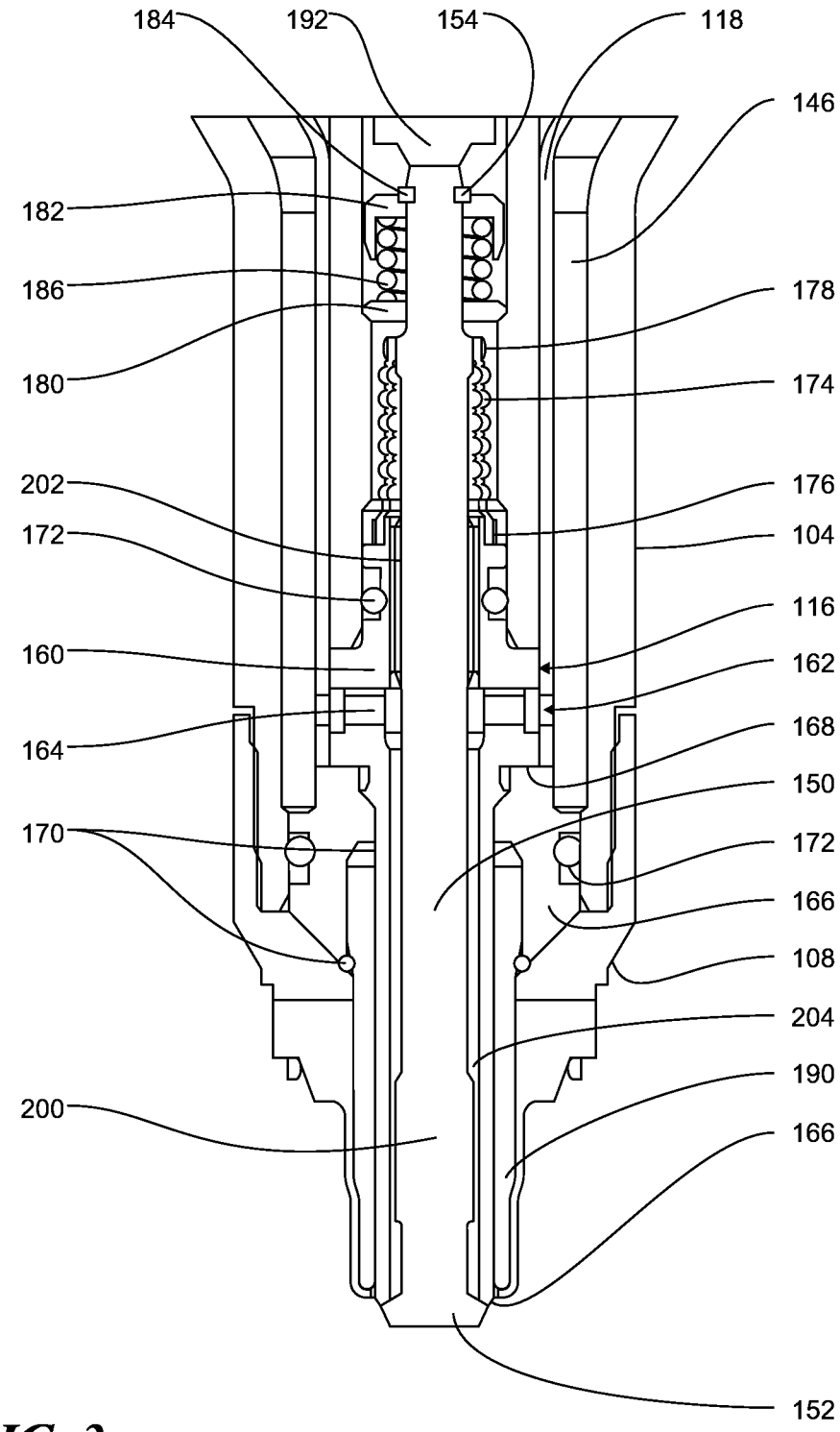
FIG. 3 is an enlarged partial cross-section of the nozzle portion of the injector-igniter shown in FIG. 1.

With further reference to FIG. 3, plunger 192 as well as insulator sleeve 142 are made from an insulating material, such as ceramic, to isolate the actuator 112 and stroke amplifier 114 from the conductor sleeve 118 (also see FIG. 2). In some embodiments, the ceramic may be a dielectric glass-ceramic composition or alumina ceramic ($Al_2O_3$), or it may be a high-temperature composite such as layered flexible mica, glass and/or polyimide film and polyimide varnish, for example. Valve assembly 116 includes a valve 150 slidably disposed in a valve seat electrode 160. As mentioned above, valve seat electrode 160 is in electrical communication with conductor sleeve 118. Thus, valve 150 is also isolated from the stroke amplifier 114 by insulator sleeve 142 and plunger 192. When actuated, plunger 192 pushes against valve 150 thereby moving valve head 152 away from valve seat 166. Valve seat electrode 160 includes electrode apertures 164 which are aligned with corresponding sleeve apertures 162. Accordingly, when valve 150 is opened, fuel supplied to outer annular gap 146 flows through sleeve apertures 162, through electrode apertures 164, along nozzle passage 204 and between valve seat 166 and valve head 152.

Valve 150 includes fluted portions 200 and 202 adapted to slide within valve seat electrode 160. Thus, the fluted portions 200 and 202 provide a bearing surface while still allowing fuel to flow along valve 150 in nozzle passage 204. Valve seat electrode 160 is further insulated from injector housing 102 by insulator ring 166 and insulator tube 190. Insulator ring 166 is sealed against fuel leakage by O-ring/backup ring seals 172 as well as Teflon® seals 170. In this embodiment, insulator ring 166 is brazed to valve seat electrode 160 at weld 168. As can be appreciated from FIG. 3, valve 150 is pressure balanced within valve seat electrode 160 by way of bellows 174. Bellows 174 also provides a seal against fuel leakage. In this embodiment, bellows 174 is welded (e.g., laser welded) to valve seat electrode 160. The welds are reinforced with weld rings 176 and 178, which help prevent additional stress from internal pressure. Valve 150 is maintained in a normally closed position by valve spring 186, which rests against spring seat 180. The valve spring 186 is retained on valve 150 by a spring retainer 182 and clip 184. Clip 184 is disposed in groove 154 which is formed around a distal end of valve 150.

Figure 4:
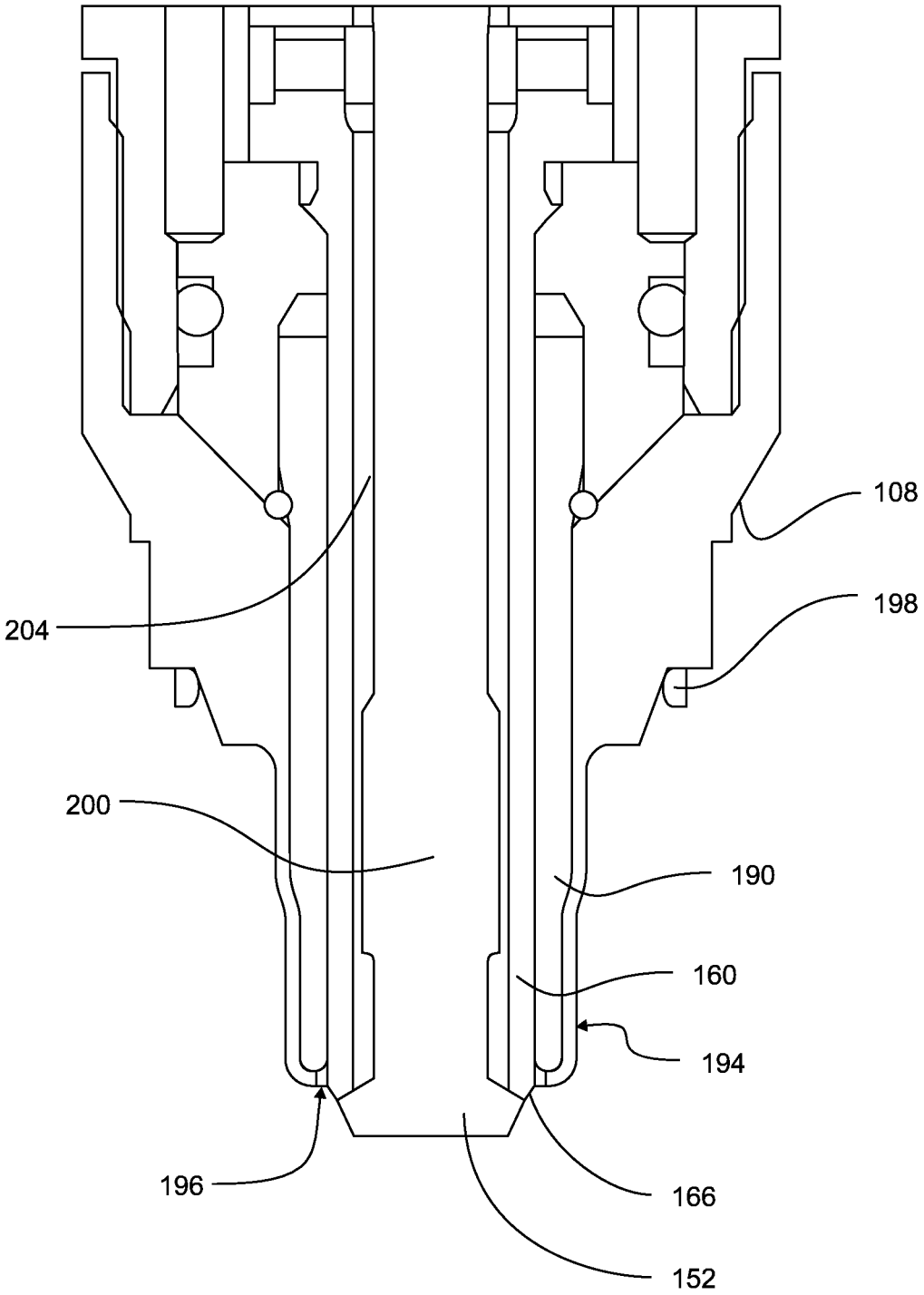
FIG. 4 is an enlarged partial cross-section view of the nozzle passage and spark gap for the injector shown in FIG. 1.

With reference to FIG. 4, it can be appreciated that nozzle cap 108 includes an electrode portion 194. It should also be appreciated that nozzle cap 108 is in contact with an engine's cylinder head and sealed thereto with a head seal ring 198. Accordingly electrode portion 194 is grounded to the engine. As described above, the valve seat electrode 160 is in electrical communication with electrode 124. Thus, voltage (e.g., ±200 VDC) applied to electrode 124 travels down electrode 124, through electrode tip 126, along conductor sleeve 118, and ultimately down valve seat electrode 160 to valve seat 166. Therefore, valve seat 166 and electrode portion 194 define an annular spark gap 196.

Figure 5:
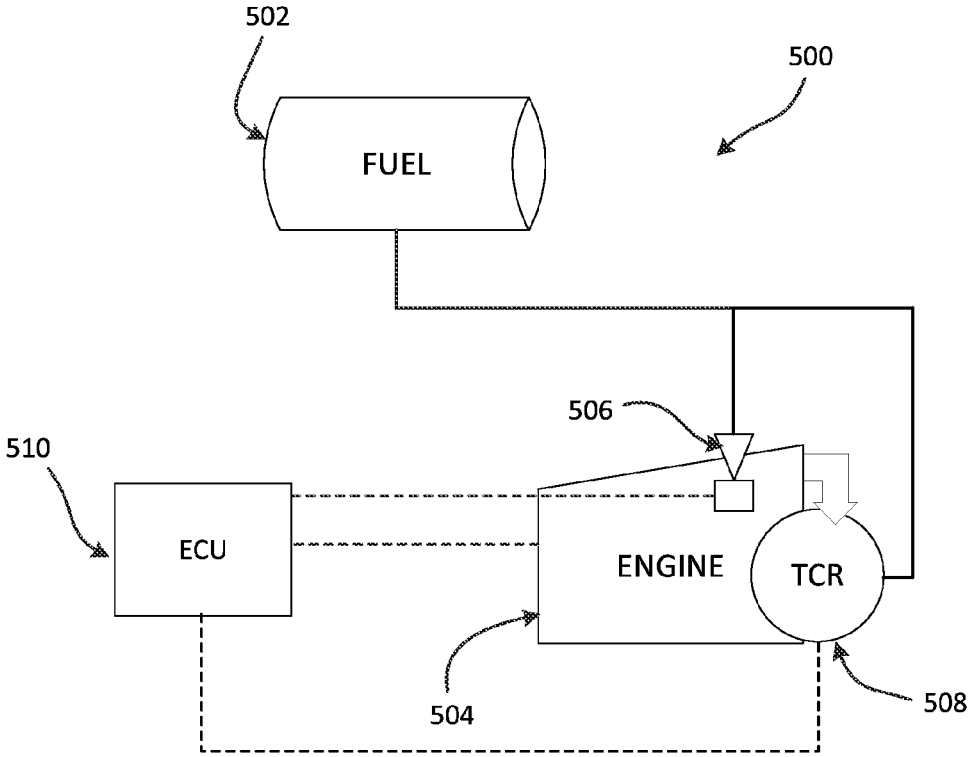
FIG. 5 is a schematic representation of a fuel injection system incorporating an injector-igniter and thermochemical regenerator.

FIG. 5 is a schematic representation of a fuel injection system 500 that includes fuel tank 502 which is operatively connected to an injector-igniter 506. Injector-igniter 506 is operative to direct-inject fuel into an engine 504. Furthermore, injector-igniter 506 is operative to provide a spark thereby initiating combustion of the fuel. Injector-igniter 506 may be the injector-igniter 100 described herein or another suitable injector-igniter. In some embodiments, the injector-igniter is operative to provide ignition energy such as thrust ions or corona discharge. In this embodiment, the fuel injection system 500 also includes a thermochemical reactor 508 to provide supplemental hydrogen for combustion enhancement. Suitable thermochemical reactors are described in co-pending U.S. patent application Ser. No. 13/027,198, entitled COUPLED THERMOCHEMICAL REACTORS AND ENGINES, AND ASSOCIATED SYSTEMS AND METHODS, filed Feb. 14, 2011, the disclosure of which is hereby incorporated by reference in its entirety. An engine control unit 510 communicates with the engine sensors and controls as well as injector-igniter 506 and thermochemical reactor 508.

Figure 6:
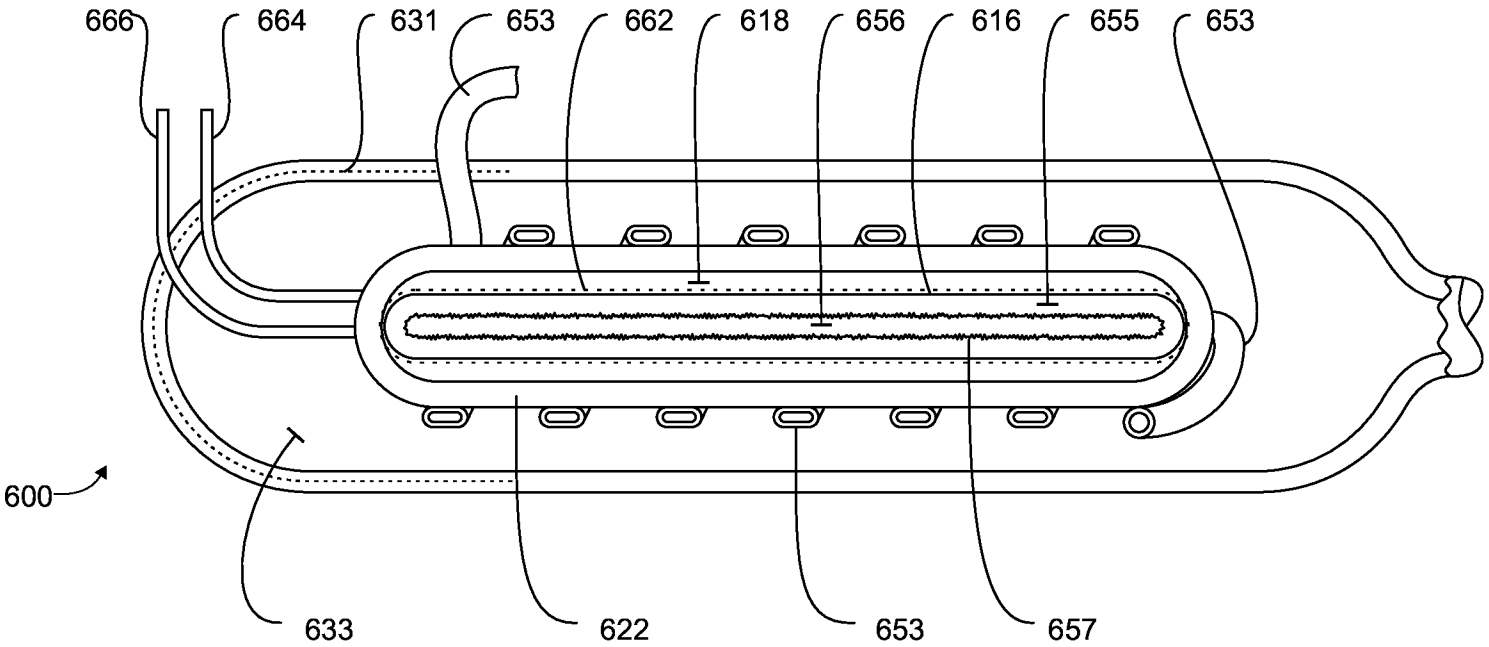
FIG. 6 is a schematic representation of a fuel injection system incorporating an injector-igniter and thermochemical regenerator with energy storage.

In certain embodiments thermochemical reactor assembly 508 includes an accumulator volume for storage of chemical and/or pressure and/or thermal potential energy. Embodiment 600 of FIG. 6, shows accumulator volume 618 for storing potential energy such as chemical, temperature, and pressure contributions to potential energy. Accumulator 618 stores hot hydrogen at high temperature such as 700 to 1500° C. (1300 to 2700° F.). Such hydrogen inventory in volume 618 includes hydrogen that has been separated by galvanic proton impetus to deliver pressurized hydrogen into this accumulator space around cathode zone 616 after production of such hydrogen in conjunction with anode zone 657 from a hydrogen donor formula or mixture that may include substances such as ammonia, urea, a fuel alcohol, formic acid, water, oxygen, or various hydrocarbons such as natural gas or other petroleum products that are delivered by conduit 653.

Figure 8A:
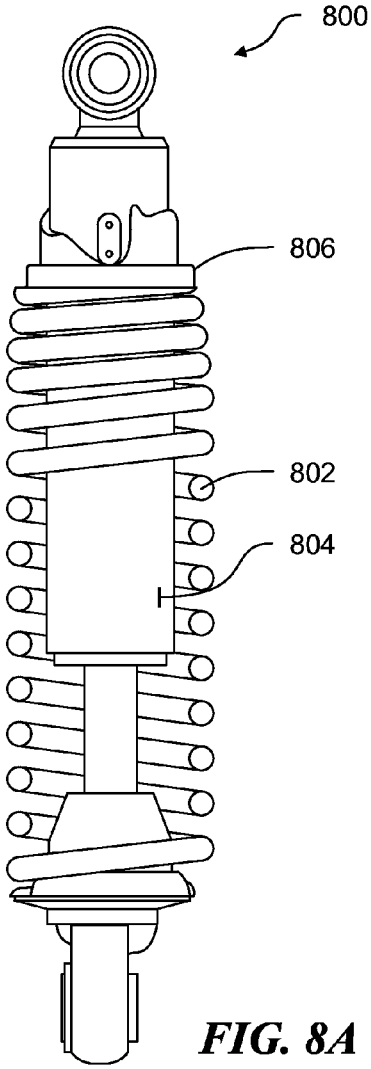
FIG. 8A is a side view in partial cross section of a spring and shock absorber arrangement according to a representative embodiment.
Figure 8B:
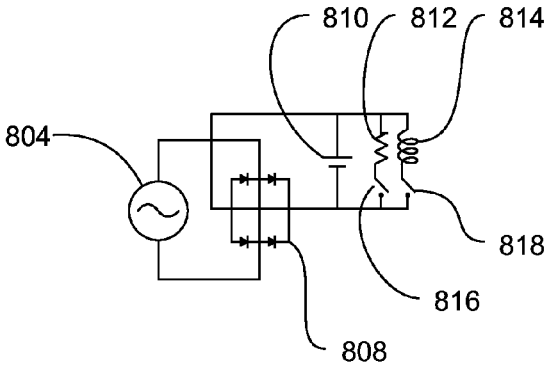
FIG. 8B is a schematic representation of a rectifier circuit for use with the spring and shock absorber arrangement shown in FIG. 8A.

Heat from a suitable source such as the exhaust 633 of engine 504 may be utilized to preheat hydrogen donor substances in heat exchanger arrangements within a suitably reinforced and insulated case 631 as partially depicted in FIG. 6. Suitable heat exchange arrangements include systems such as the helical coil surrounding pressure containment tube or vessel 622 as shown prior to admission of such hydrogen donor fluid into the tubular bore of accumulator 656 within tube or pressure vessel 655. Additional heat may be added by resistance or inductive heater 662 using electricity from a suitable source such as the regeneratively produced electricity from stopping a vehicle and/or from regenerative shock absorbers and/or suspension springs. Such sources of electricity are also utilized to provide an electrical potential between electrode-anode 657 and electrode cathode 616 to produce galvanic impetus to separate and deliver hot, pressurized hydrogen into accumulator 618. FIGS. 8A and 8B illustrate a typical assembly 800 that includes a spring and shock absorber arrangement for serving between components such as vehicle carriage and traction or support components. Embodiment 800 includes micro-controller 806 and provides regenerative electricity production as a result of the actions of shock absorber 804 and/or spring 802 including electrostatic, electromagnetic, electro-pneumatic, electro-hydraulic and/or piezoelectric generation of electricity.

As shown in FIG. 8B electricity such as direct, pulsed direct, and/or alternating current is produced by assembly 800 such as depicted by power 804 is rectified by full wave bridge 808 and delivered to suitable storage such as a battery and/or capacitor 810 and thus through resistance and/or inductive coupling 812, 814 to applications such as heating the reactor-separator 655 within assembly 600 of FIG. 6 as controlled through switches 816 and/or 818.

In some embodiments, hot gases including mixtures not entirely converted to hydrogen such as portions of feedstock fuels, carbon monoxide, carbon dioxide, nitrogen, and/or water vapor are provided from accumulator 656 to injector 506 through suitably insulated and or cooled conduit 666.

High pressure hydrogen is delivered through insulated or cooled conduit 664 to injector 506.

It may be advantageous in certain embodiments to utilize the injector type 700 shown in FIGS. 7A-7D to deliver gases that have been cooled into engine 504 before top dead center (TDC) to perform cooling of the oxidant such as air and thus reduce the back work of compression and thus to provide improved brake mean effective pressure (BMEP) in the operation of engine 504. Subsequently, hot hydrogen is delivered as a high pressure expansion heating substance at or after TDC to increase the BMEP of engine 506 and to improve the combustion characteristics including acceleration of the ignition and completion of combustion of fuel delivered through conduits 664 and 666.

Figure 7A:
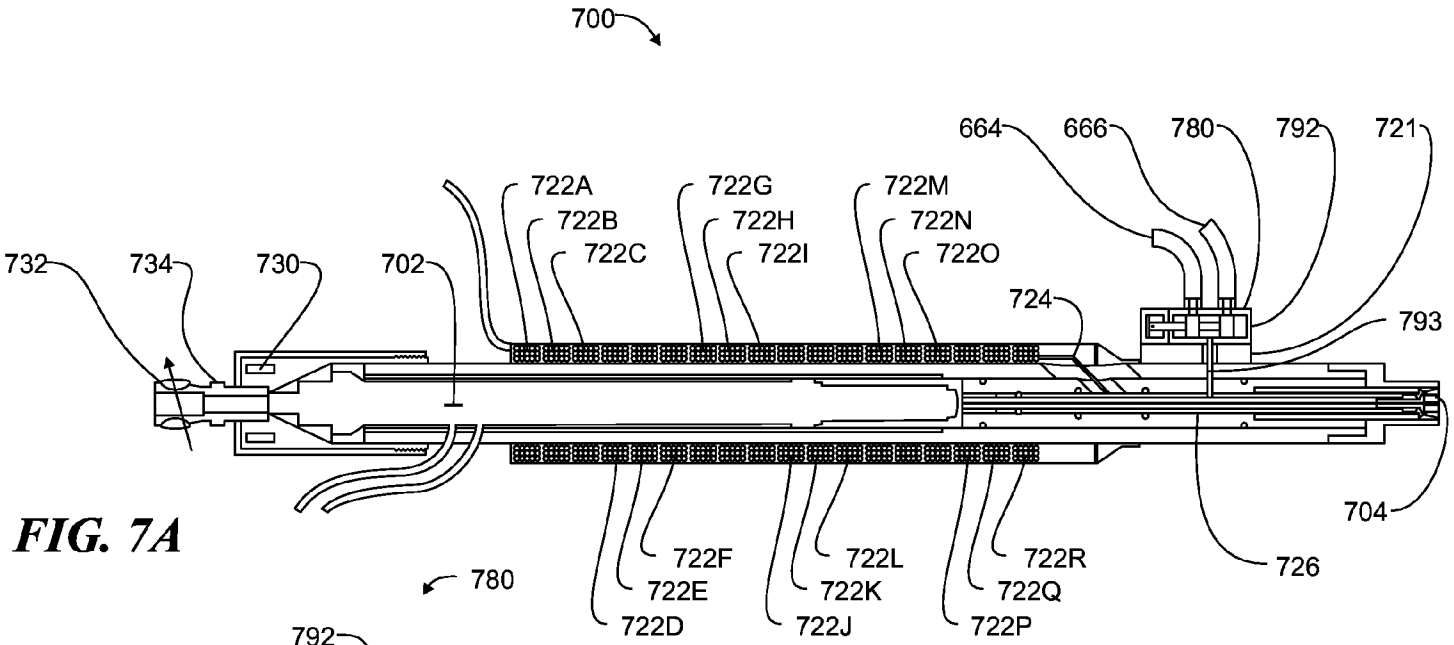
FIG. 7A is a cross-sectional side view of an injector-igniter according to a representative embodiment.
Figure 7D:
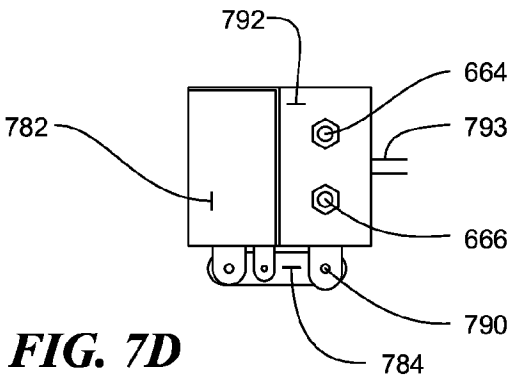
FIG. 7D is an enlarged view of the valve assembly shown in FIG. 7A.
Figure 7B:
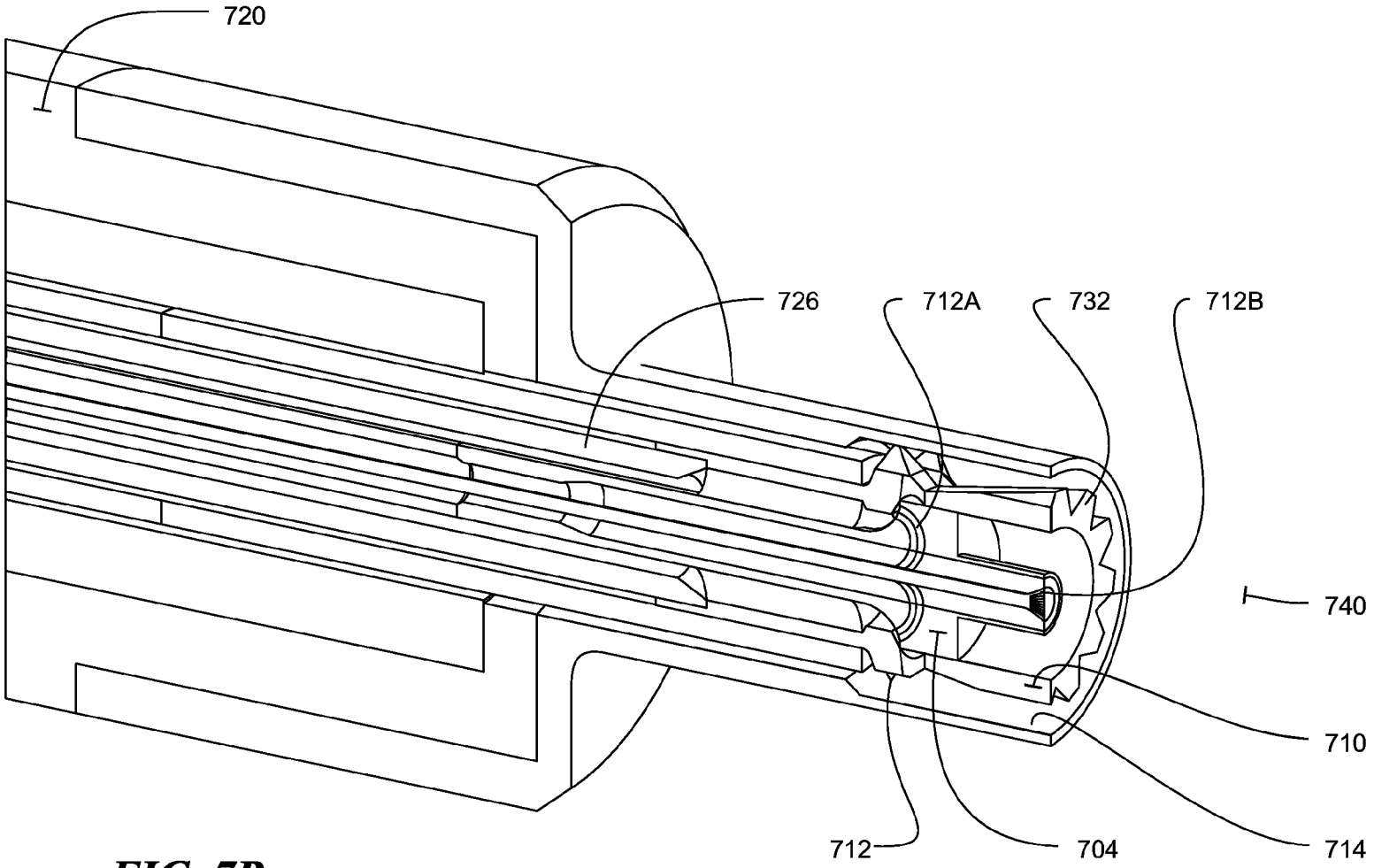
FIG. 7B is an enlarged cross-sectional perspective view of the nozzle portion of the injector-igniter shown in FIG. 7A.
Figure 7C:
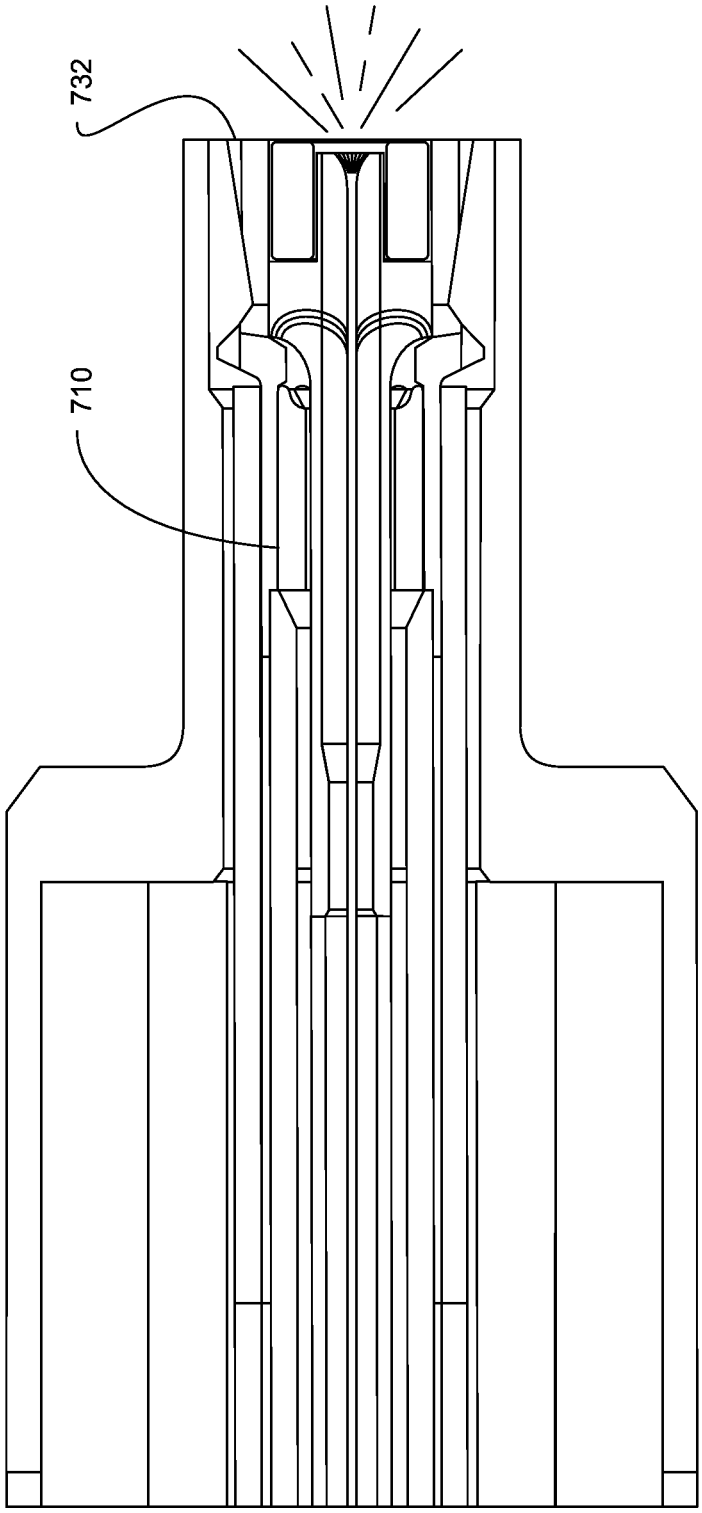
FIG. 7C is an enlarged cross-sectional side view of the nozzle portion of the injector-igniter shown in FIGS. 7A and 7B.

Injector 700 utilizes a suitable valve operator such as a pneumatic, hydraulic, electromagnetic, magnetostrictive or piezoelectric assembly 702 to control the opening and/or closing of fuel control valve 704 which is shown in FIGS. 7B and 7C. Fuels from accumulator 656 may be cooled including achievement of temperatures that approach cryogenic methane or hydrogen in instances that a suitable fuel tank 502 is utilized for such storage.

At selected times such as during the compression cycle of oxidant in engine 504, pressurized fluid from conduit 666 is selected by a rapid response valve assembly such as 780 which may be actuated by a pneumatic, hydraulic, electromagnetic, magnetostrictive, or piezoelectric actuator 782 (see FIG. 7D) to produce output through linkage 788 and mechanically amplified stroke through linkage 790 by lever linkage 784 to move a suitable valve such as a spool valve within case 792 to deliver fluid (e.g. hot high pressure hydrogen from accumulator 618 through conduit 664 or suitably conditioned such as cooled fluid through conduit 666 to conduit 793 for injection controlled by valve 704 as shown.

Valve assembly 780 is provided at a suitable location such as on insulator 721 as shown for purposes of functionally isolating (e.g. hot, corrosive, or cold) fluids provided to the combustion chamber of engine 504 as controlled by operation of valve 704. At other selected times another fluid that is delivered through fitting 734 from pressure regulator 732 such as may be used to cool and/or provide deliveries of incipient crack repair agents such as activated monomers and/or precursors for polymeric, glass, ceramic, or composite insulation systems such as 720 which may include components that also may provide functions such as charge storage as capacitors.

In operation, valve 704 is opened and/or closed by actuator 702. In some embodiments a piezoelectric stack 702 with sufficiently long actuation stroke is selected and is controlled by adaptively adjusted applied voltage to open valve 704 variable distances to control the rate of fluid flow such as fuel delivery into the combustion chamber of engine 504. With further reference to FIG. 7B, instrumentation such as may be provided and/or relayed to microcontroller 730 by components 712 such as light pipes or fiber optics 712A monitor the opening from the valve seat portion of in electrode component 710 to control actuator 702 to and/or flow delivered past valve 704 as shown. Additional instrumentation 712B monitors and relays combustion chamber information to controller 730 such as temperature, pressure, injected fluid penetration and patterns including intake, compression, combustion, and exhaust events.

Injection and/or ignition of fuel delivered through valve 702 is through the annular pathway and/or channels between electrode features such as 732 (see FIG. 7C) which may produce swirl or other shapes of fluid such as fuel projections into combustion chamber 740. Ignition may be selected from spark, ion thrusting, and/or corona discharge within combustion chamber 740. Illustratively, ion production and acceleration starting with ion current development between relatively small gaps between one or more tips 712 and a suitably shaped counter electrode 714 provides ion thrusting of adaptively adjusted ion populations by controller 730 in response to information such as may be relayed through filaments 712A and/or 712B. Corona discharge may follow such ion launch patterns for further ion production and/or ionizing radiation accelerated initiation and/or completion of combustion operations.

With reference again to FIG. 7A, low voltage electricity may be utilized to operate system 700 and may be supplied from suitable circuits within controller assembly 730 or at other suitable locations including production of high voltage for spark, ion thrusting and/or corona ignition by selected transformer elements and cells of assembly 722A-722R as shown with abbreviated designations of such inductive windings. High voltage is delivered through one or more insulated conductors 724 to conductor tube 726 and thus to electrode 710 as shown for such applications.

From the foregoing it will be appreciated that, although specific embodiments of the technology have been described herein for purposes of illustration, various modifications may be made without deviating from the spirit and scope of the technology. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Also contemplated herein are methods that may include any procedural step inherent in the structures and systems described herein. Accordingly, the disclosure and associated technology can encompass other embodiments not expressly shown or described herein. The following examples provide additional embodiments of the present technology.

EXAMPLES

1. A fuel injection system, comprising:
   an injector-igniter, including:
   an injector housing;
   an outwardly opening valve assembly including a valve and a valve seat electrode located within the injector housing and forming an annular spark gap between the valve seat electrode and an electrode portion of the injector housing; and
   an actuator disposed in the housing operatively connected to the valve; and
   a fuel tank in fluid communication with the injector-igniter.

2. The fuel injection system according to example 1, further comprising a thermochemical reactor operatively coupled to the injector-igniter.

3. The fuel injection system according to example 1, wherein the actuator is a piezoelectric actuator.

4. The fuel injection system according to example 3, further comprising a hydraulic stroke amplifier disposed between the actuator and valve.

5. The fuel injection system according to example 1, further comprising a conductor sleeve supported between the actuator and injector housing with a first annular gap between the injector housing and the conductor sleeve and a second annular gap between the actuator body and conductor sleeve.

6. The fuel injection system according to example 5, wherein the first and second annular gaps are in fluid communication with a fuel inlet, whereby fuel provides a dielectric between the conductor sleeve and the injector housing.

7. The fuel injection system according to example 1, further comprising an insulator tube positioned between the injector housing and valve seat electrode.

8. The fuel injection system according to example 7, wherein the insulator tube comprises ceramic material.

9. A fuel injection system, comprising:

an injector-igniter, including:

an injector housing;

an outwardly opening valve assembly including a valve and a valve seat electrode located within the injector housing and forming an annular spark gap between the valve seat electrode and an electrode portion of the injector housing; and an actuator disposed in the housing operatively connected to the valve;

a fuel tank in fluid communication with the injector-igniter; and a thermochemical reactor operatively coupled to the injector-igniter.

10. The fuel injection system according to example 9, wherein the actuator is a piezoelectric actuator.

11. The fuel injection system according to example 10, further comprising a hydraulic stroke amplifier disposed between the actuator and valve.

12. The fuel injection system according to example 9, further comprising a conductor sleeve supported between the actuator and injector housing with a first annular gap between the injector housing and the conductor sleeve and a second annular gap between the actuator and conductor sleeve.

13. The fuel injection system according to example 12, wherein the first and second annular gaps are in fluid communication with a fuel inlet, whereby fuel provides a dielectric between the conductor sleeve and the injector housing.

14. The fuel injection system according to example 9, further comprising an insulator tube positioned between the injector housing and valve seat electrode.

15. The fuel injection system according to example 14, wherein the insulator tube comprises ceramic material.

16. An injector-igniter, comprising:

an injector housing;

a valve assembly including a valve and a valve seat electrode located within the injector housing and forming an annular spark gap between the valve seat electrode and an electrode portion of the injector housing;

an actuator disposed in the housing operatively connected to the valve; and a conductor sleeve supported between the actuator and injector housing, and electrically connected to the valve seat electrode.

17. The injector-igniter according to example 16, wherein the conductor sleeve defines a first annular gap between the injector housing and the conductor sleeve and a second annular gap between the actuator and conductor sleeve, wherein the first and second annular gaps are in fluid communication with a fuel inlet, whereby fuel provides a dielectric between the conductor sleeve and the injector housing.

18. The injector-igniter according to example 16, further comprising an electrode connector extending laterally from the injector housing and including a spring loaded electrode tip contacting the conductor sleeve.

19. The injector-igniter according to example 16, wherein the actuator is a piezoelectric actuator and further comprising a hydraulic stroke amplifier disposed between the actuator and valve.

20. The injector-igniter according to example 16, further comprising a ceramic insulator tube positioned between the injector housing and valve seat electrode.

I claim:

1. A fuel injection system, comprising:

an injector-igniter, including:

an injector housing;

an outwardly opening valve assembly including a valve and a valve seat electrode located within the injector housing and forming an annular spark gap between the valve seat electrode and an electrode portion of the injector housing; and an actuator disposed in the housing operatively connected to the valve; and a fuel tank in fluid communication with the injector-igniter.

2. The fuel injection system according to claim 1, further comprising a thermochemical reactor operatively coupled to the injector-igniter.

3. The fuel injection system according to claim 1, wherein the actuator is a piezoelectric actuator.

4. The fuel injection system according to claim 3, further comprising a hydraulic stroke amplifier disposed between the actuator and valve.

5. The fuel injection system according to claim 1, further comprising a conductor sleeve supported between the actuator and injector housing with a first annular gap between the injector housing and the conductor sleeve and a second annular gap between the actuator body and conductor sleeve.

6. The fuel injection system according to claim 5, wherein the first and second annular gaps are in fluid communication with a fuel inlet, whereby fuel provides a dielectric between the conductor sleeve and the injector housing.

7. The fuel injection system according to claim 1, further comprising an insulator tube positioned between the injector housing and valve seat electrode.

8. The fuel injection system according to claim 7, wherein the insulator tube comprises ceramic material.

9. A fuel injection system, comprising:

an injector-igniter, including:

an injector housing;

an outwardly opening valve assembly including a valve and a valve seat electrode located within the injector housing and forming an annular spark gap between the valve seat electrode and an electrode portion of the injector housing; and an actuator disposed in the housing operatively connected to the valve;

a fuel tank in fluid communication with the injector-igniter; and a thermochemical reactor operatively coupled to the injector-igniter.

10. The fuel injection system according to claim 9, wherein the actuator is a piezoelectric actuator.

11. The fuel injection system according to claim 10, further comprising a hydraulic stroke amplifier disposed between the actuator and valve.

12. The fuel injection system according to claim 9, further comprising a conductor sleeve supported between the actuator and injector housing with a first annular gap between the injector housing and the conductor sleeve and a second annular gap between the actuator and conductor sleeve.

13. The fuel injection system according to claim 12, wherein the first and second annular gaps are in fluid communication with a fuel inlet, whereby fuel provides a dielectric between the conductor sleeve and the injector housing.

14. The fuel injection system according to claim 9, further comprising an insulator tube positioned between the injector housing and valve seat electrode.

15. The fuel injection system according to claim 14, wherein the insulator tube comprises ceramic material.

16. An injector-igniter, comprising:

an injector housing;

a valve assembly including a valve and a valve seat electrode located within the injector housing and forming an annular spark gap between the valve seat electrode and an electrode portion of the injector housing;

an actuator disposed in the housing operatively connected to the valve; and a conductor sleeve supported between the actuator and injector housing, and electrically connected to the valve seat electrode.

17. The injector-igniter according to claim 16, wherein the conductor sleeve defines a first annular gap between the injector housing and the conductor sleeve and a second annular gap between the actuator and conductor sleeve, wherein the first and second annular gaps are in fluid communication with a fuel inlet, whereby fuel provides a dielectric between the conductor sleeve and the injector housing.

18. The injector-igniter according to claim 16, further comprising an electrode connector extending laterally from the injector housing and including a spring loaded electrode tip contacting the conductor sleeve.

19. The injector-igniter according to claim 16, wherein the actuator is a piezoelectric actuator and further comprising a hydraulic stroke amplifier disposed between the actuator and valve.

20. The injector-igniter according to claim 16, further comprising a ceramic insulator tube positioned between the injector housing and valve seat electrode.

* * * * *